US007701396B2

(12) United States Patent
Cohen

(10) Patent No.: US 7,701,396 B2
(45) Date of Patent: Apr. 20, 2010

(54) WIDE-BAND FRACTAL ANTENNA

(75) Inventor: Nathan Cohen, Belmont, MA (US)

(73) Assignee: Fractal Antenna Systems, Inc., Waltham, MA (US)

( * ) Notice: Subject to any disclaimer, the term of this patent is extended or adjusted under 35 U.S.C. 154(b) by 11 days.

(21) Appl. No.: 11/716,909

(22) Filed: Mar. 12, 2007

(65) Prior Publication Data

US 2007/0171133 A1 Jul. 26, 2007

Related U.S. Application Data

(63) Continuation of application No. 10/812,276, filed on Mar. 29, 2004, now Pat. No. 7,190,318.

(60) Provisional application No. 60/458,333, filed on Mar. 29, 2003.

(51) Int. Cl.
*H01Q 1/38* (2006.01)
*H01Q 13/00* (2006.01)

(52) U.S. Cl. ..... 343/700 MS; 343/773

(58) Field of Classification Search ..... 343/773, 343/774, 700 MS, 786
See application file for complete search history.

(56) References Cited

U.S. PATENT DOCUMENTS

| | | | | |
|---|---|---|---|---|
| 3,115,630 | A * | 12/1963 | Lanford | 342/10 |
| 3,656,166 | A | 4/1972 | Klopach et al. | |
| 3,829,863 | A | 8/1974 | Lipsky | |
| 3,987,456 | A | 10/1976 | Gelin | |
| 4,143,377 | A | 3/1979 | Salvat et al. | |
| 4,851,859 | A * | 7/1989 | Rappaport | 343/790 |
| 5,028,928 | A * | 7/1991 | Vidmar et al. | 342/10 |
| 5,345,238 | A * | 9/1994 | Eldridge et al. | 342/3 |
| 5,523,767 | A * | 6/1996 | McCorkle | 343/810 |
| 6,140,975 | A | 10/2000 | Cohen | |
| 7,286,095 | B2 * | 10/2007 | Parsche et al. | 343/773 |
| 7,352,334 | B2 * | 4/2008 | Kuroda et al. | 343/772 |

OTHER PUBLICATIONS

Syntony and Spark, H. Aitkin, Princeton (1985), p. 133.

* cited by examiner

*Primary Examiner*—Huedung Mancuso
(74) *Attorney, Agent, or Firm*—McDermott Will & Emery LLP

(57) ABSTRACT

An apparatus includes a discone antenna including a cone-shaped element whose physical shape is at least partially defined by at least one pleat.

2 Claims, 7 Drawing Sheets

WIDE-BAND FRACTAL ANTENNA

CROSS-REFERENCE TO RELATED APPLICATIONS

This application is a continuation application of U.S. patent application Ser. No. 10/812,276, filed Mar. 29, 2004, now U.S. Pat. No. 7,190,318 which application claims priority to U.S. Provisional Application No. 60/458,333, filed Mar. 29, 2003, both of which are incorporated herein by reference in their entireties.

BACKGROUND OF THE INVENTION

The present invention relates to wideband performance antenna, and more particularly, to discone or bicone antenna.

Antenna are used to radiate and/or receive typically electromagnetic signals, preferably with antenna gain, directivity, and efficiency. Practical antenna design traditionally involves trade-offs between various parameters, including antenna gain, size, efficiency, and bandwidth. Antenna size is also traded off during antenna design that typically reduces frequency bandwidth. Being held to particular size constraints, the bandwidth performance for antenna designs such as discone and bicone antennas is sacrificed resulted in reduced bandwidth.

SUMMARY OF THE INVENTION

In one implementation, an apparatus includes a discone antenna including a cone-shaped element whose physical shape is at least partially defined by at least one pleat.

One or more of the following features may also be included. The discone antenna may include a disc-shaped element whose physical shape is at least partially defined by a fractal geometry. The physical shape of the cone-shaped element may include a least one hole. The physical shape of the cone-shaped element may be at least partially defined by a series of pleats that extend about a portion of the cone.

In another implementation, an apparatus includes a bicone antenna including two cone-shaped elements whose physical shape is at least partially defined by at least one pleat.

One or more of the following features may also be included. The physical shape of one of the two cone-shaped elements may be at least partially defined by at least one hole. The physical shape of one of the two cone-shaped elements may be at least partially defined by a series of pleats that extend about a portion of the cone.

In another implementation, an apparatus includes an antenna including a disc-shaped element whose physical shape is at least partially defined by a fractal geometry.

One or more of the following features may also be included. The physical shape of the disc-shaped element may be at least partially defined by a hole.

DESCRIPTION OF THE PREFERRED EMBODIMENTS

Figure 1:
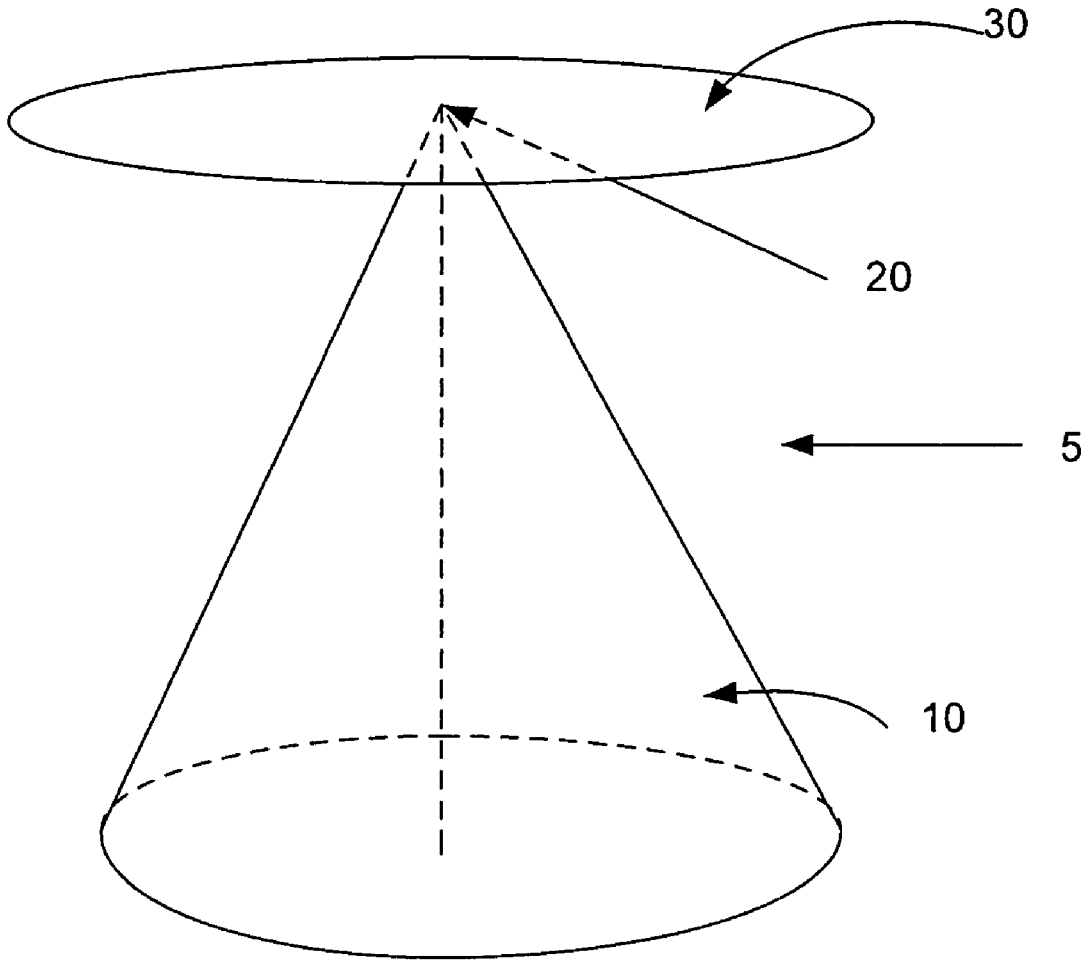
(PRIOR ART) FIG. 1
FIG. 1 depicts a conventional discone antenna.

In general, a wideband requirement for an antenna, especially a dipole-like antenna, has required a bicone or discone shape to afford the performance desired over a large pass band. For example, some pass bands desired exceed 3:1 as a ratio of lowest to highest frequencies of operation, and typically ratios of 20:1 to 100:1 are desired. Referring to FIG. 1, prior art discone antenna 5 includes a sub-element 10 shaped as a cone whose apex is attached to one side of a feed system at location 20. A second sub-element 30 is attached to the other side of the feed system, such as the braid of a coaxial feed system. This sub-element is a flat disk meant to act as a counterpoise.

Figure 2:
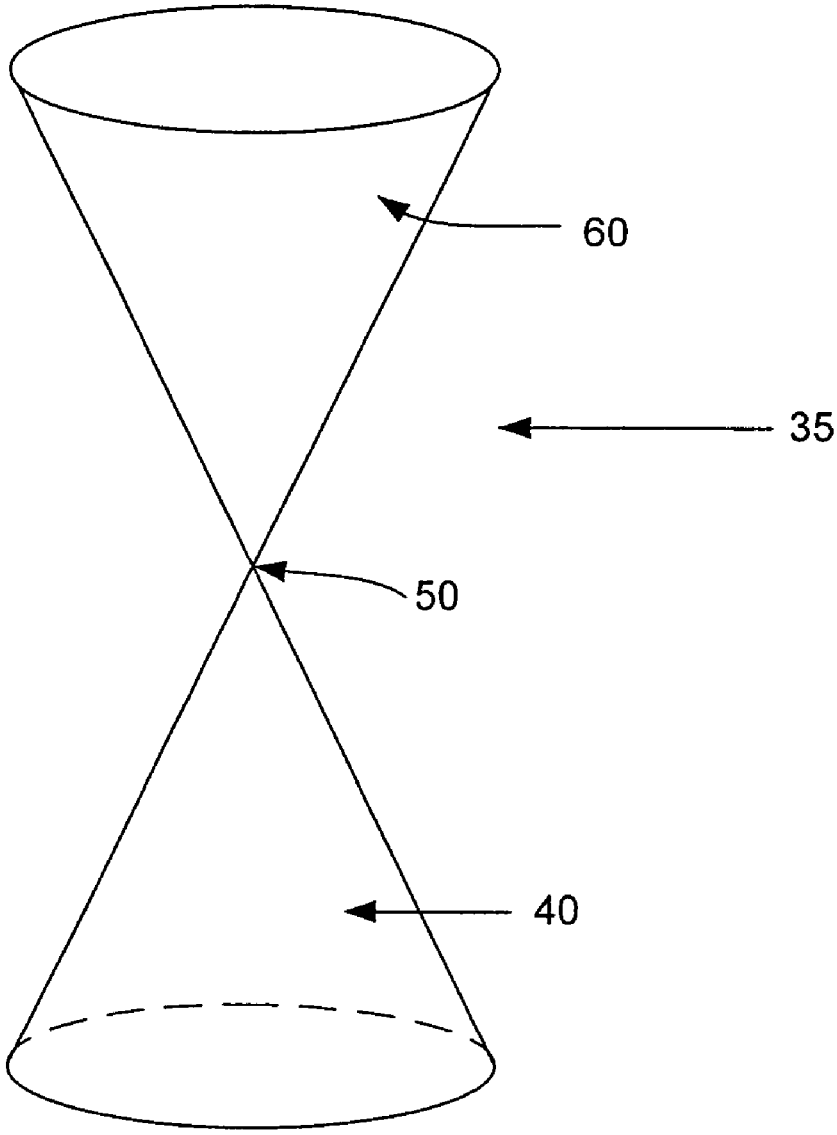
(PRIOR ART) FIG. 2
FIG. 2 depicts a conventional bicone antenna

Referring to FIG. 2, another current antenna design is depicted that includes a bicone antenna 35, in which a sub-element 40 is arranged similar to sub-element 10 shown the discone antenna 5 of FIG. 1 with a similar feed arrangement at location 50. However, for bicone antenna 35 rather than a second sub-element shaped as a disk, a second cone 60 is attached.

Both discone and bicone antennas afford wideband performance often over a large ratio of frequencies of operation; in some arrangements more than 10:1. However, such antennas are often ¼ wavelength across, as provided by the longest operational wavelength of use, or the lowest operating frequency. In height, the discone is typically ¼ wavelength and the bicone almost ½ wavelength of the longest operational wavelength. Typically, when the lowest operational frequency corresponds to a relatively long wavelength, the size and form factor of these antenna becomes cumbersome and often prohibitive for many applications.

Figure 3:
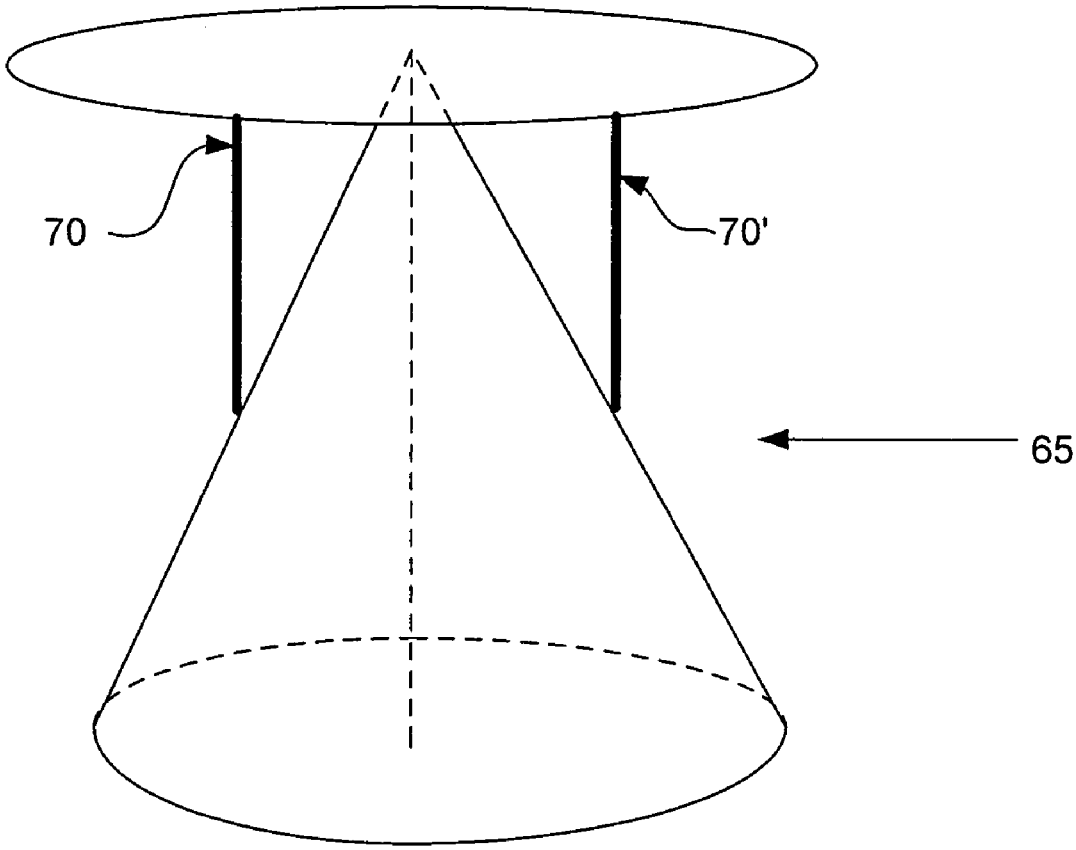
(PRIOR ART) FIG. 3
FIG. 3 depicts a shorted discone antenna.

Some investigations have attempted to solve this problem with a shorted discone antenna 65 as depicted in FIG. 3. Here, 'vias' are used to electrically short the disk to the cone at specific locations as 70 and 70'. Typically this shorting decreases the lowest operational frequency of the antenna. However, the gain does not improve from this technique.

Figure 4:
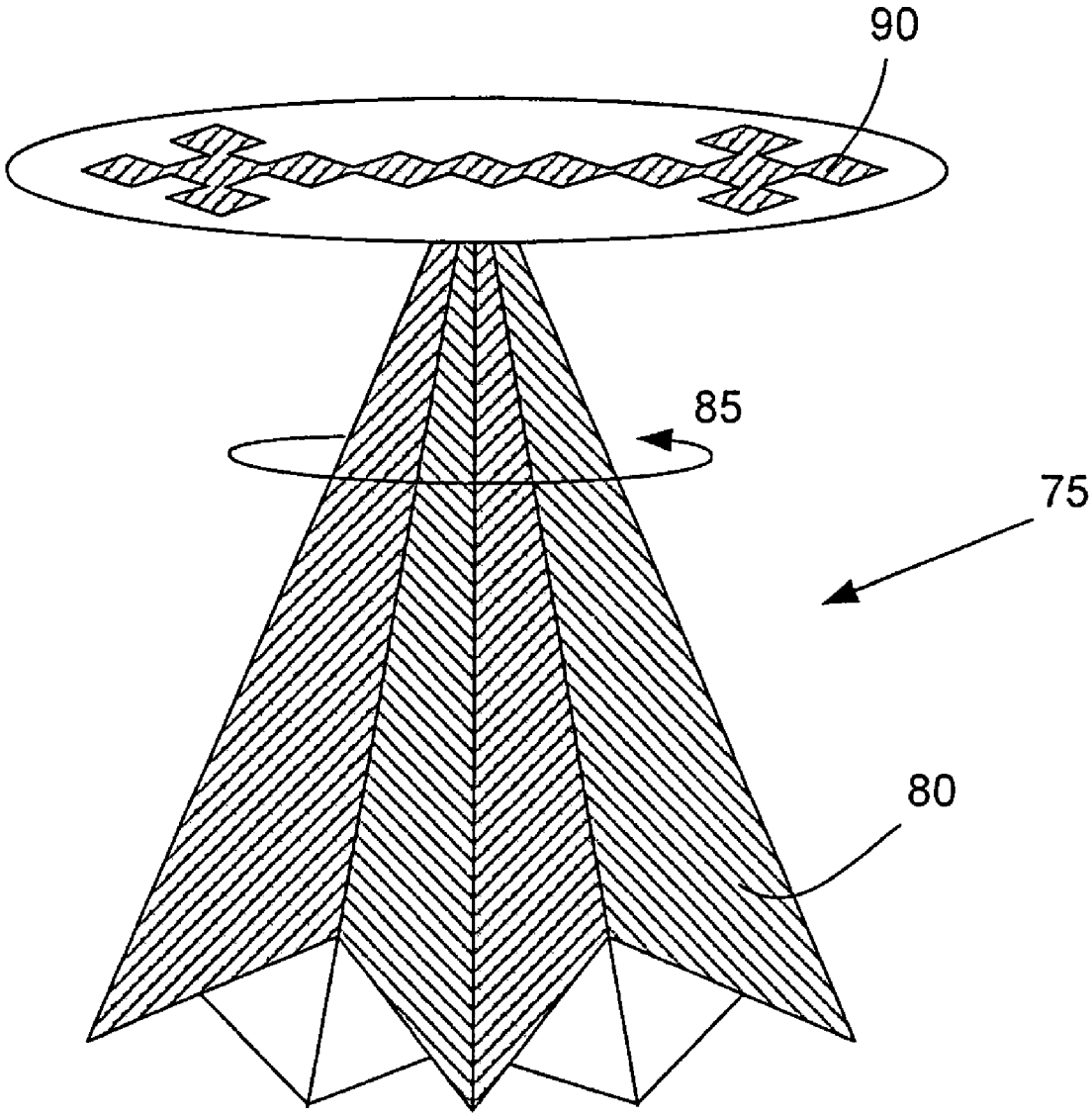
FIG. 4 depicts a discone antenna including a pleated cone and a disk.

Referring to FIG. 4, to provide wider bandwidth performance, while allowing for reduced size and form factors, shaping techniques are incorporated into the components of the antenna. For example, a discone antenna 75 includes a conical portion 80 that includes pleats that extend about a circumference 85 of the conical portion. Along with incorporating pleats into the conical portion of the discone antenna 75, to further improve bandwidth performance while allowing for relative size reductions based on operating frequencies, shaping techniques are incorporation into the disc element of the antenna. In this example, a disc element 90 of the discone antenna 75 is defined by a fractal geometry, such as the fractal geometries described in U.S. Pat. No. 6,140,975, filed Nov. 7, 1997, which is herein incorporated by reference. By incorporating the pleats into the conical portion and the fractal (i.e., self-similar) disc design, the size of the discone antenna 74 is approximately one half of the size of the discone antenna 5 (shown in FIG. 1) while providing similar frequency coverage and performance.

Figure 5:
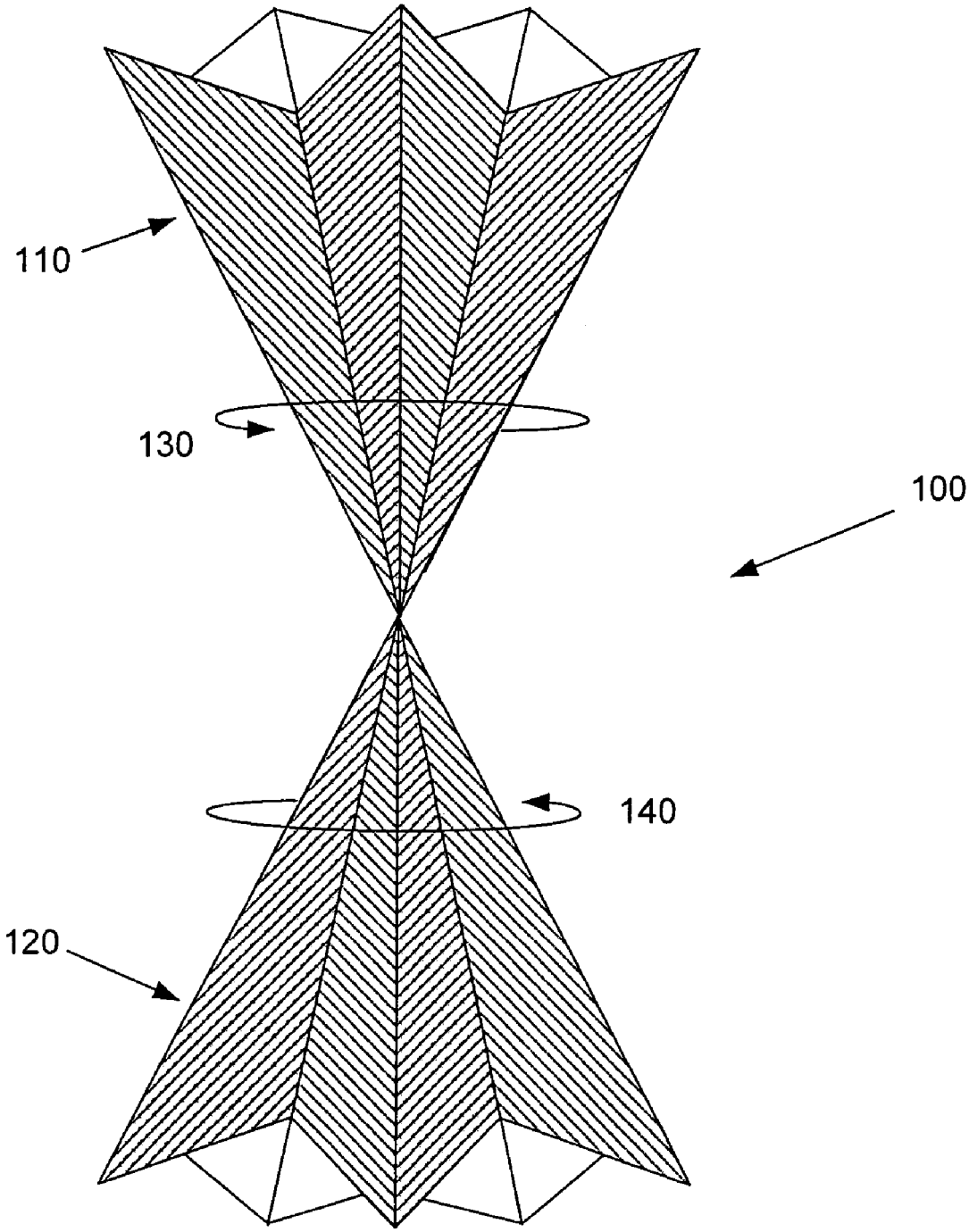
FIG. 5 depicts a bicone antenna including two pleated cones.

Referring to FIG. 5, a bicone antenna 100 is shown that includes two conical portions 110, 120. Each of the two conical portions 110, 120 are respectively defined by pleats that extend about the respective circumferences 130, 140 of the two portions. By incorporating the pleat-shaping into the conical portions 110, 120, the bicone antenna 100 provides the frequency and beam-pattern performance of a larger sized bicone antenna that does not include shaping, such as the bicone antenna 35 (shown in FIG. 2).

While the shaping techniques implemented in the discone antenna 75 (shown in FIG. 4) and the bicone antenna 100 (shown in FIG. 5) utilized a pleat-shape in the conical portions and a fractal shape in the disc portion, other geometric shapes, including one or more holes, can be incorporated into the antenna designs.

Figure 6:
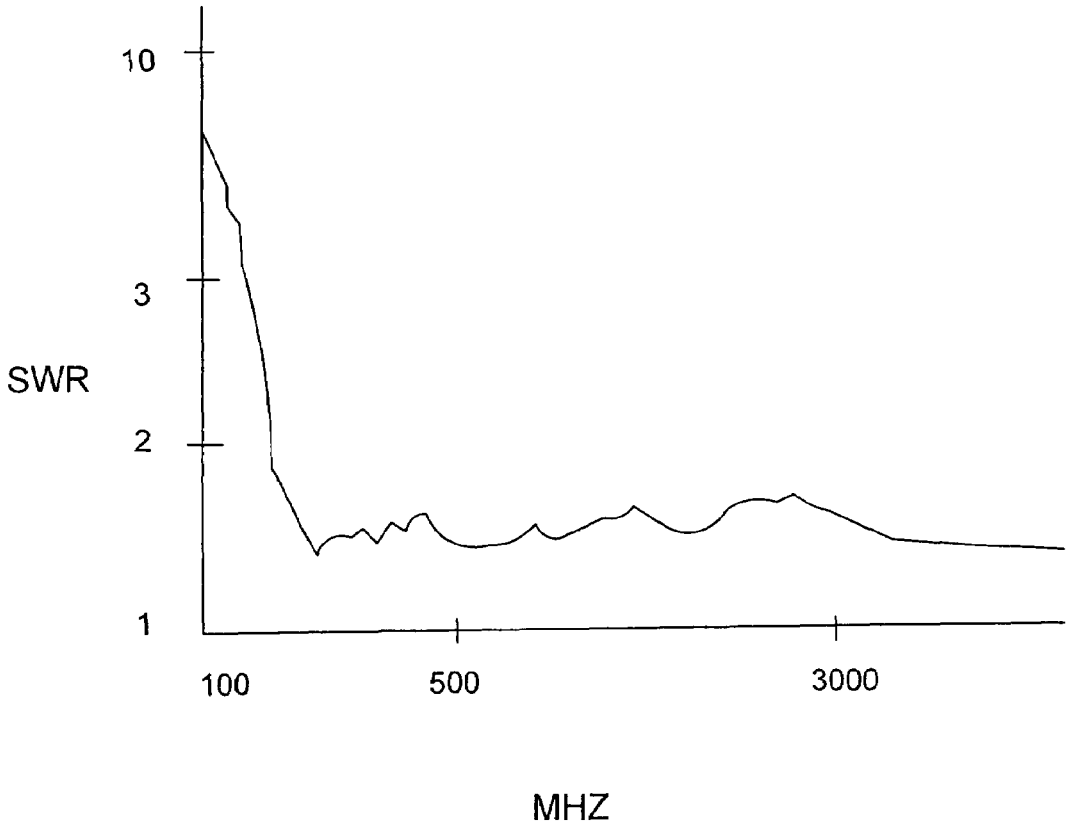
FIG. 6 depicts an SWR chart revealing the impedance response of the antenna depicted in FIG. 3.
Figure 7:
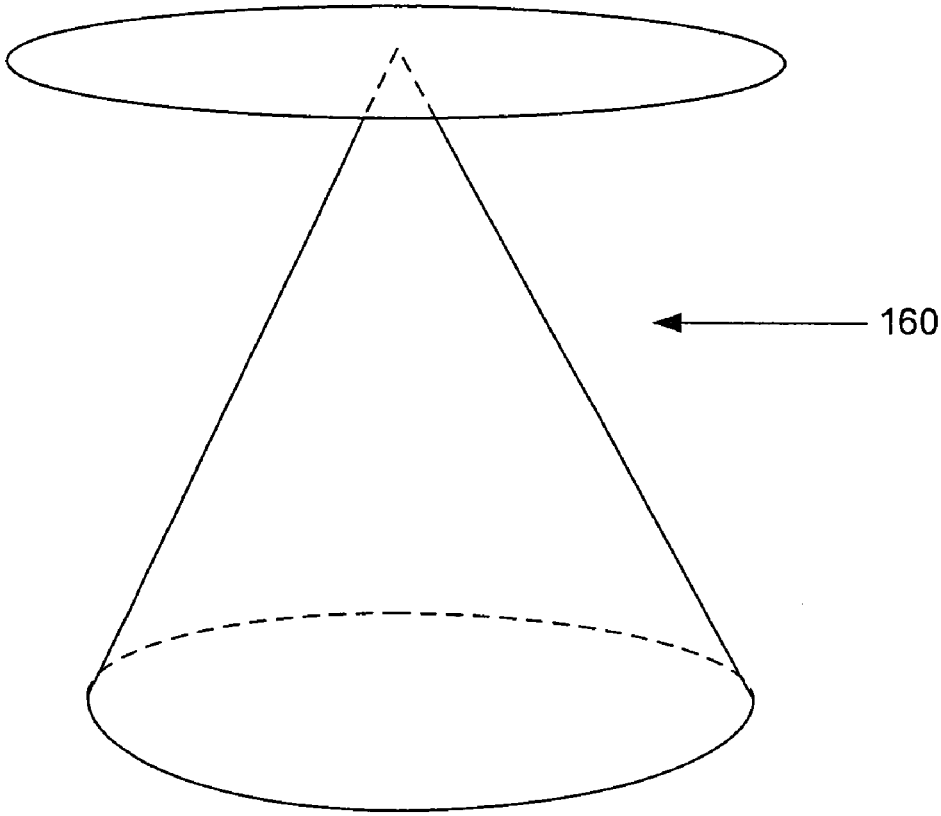
FIG. 7 depicts a relative size comparison between the conventional discone antenna depicted in FIG. 1 and the discone antenna depicted in FIG. 3.
Figure 7:
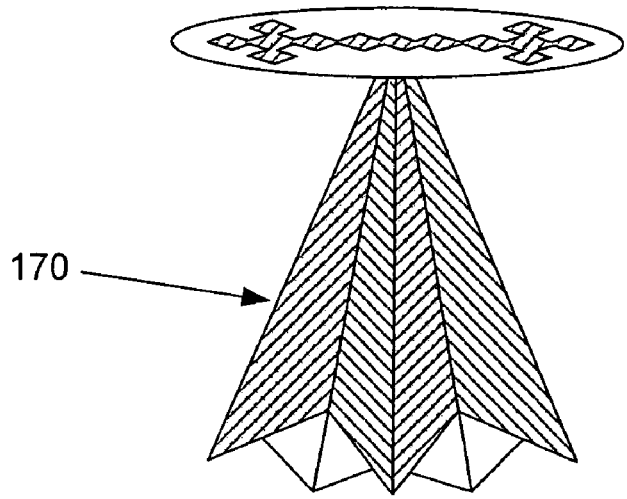

Referring to FIG. 6, by incorporating these shaping techniques, for example, into a discone antenna, such as the discone antenna 75 (shown in FIG. 4), the standing wave ratio (SWR) of the antenna demonstrates the performance improvement. For example, X-Y chart 150 depicts a wide-band 50 ohm match of the discone antenna across the entire frequency band (e.g., 100 MHz-3000 MHz). Along with improving performance over the operating frequency band, and extending the operational frequency band, referring to FIG. 7., by incorporating the shaping techniques, a discone antenna 170 that includes pleats and a fractal shaped disc is relatively smaller and provides similar performance than a discone antenna 160 that does not incorporate the shaping techniques.

What is claimed is:

1. An apparatus comprising:

an antenna including a flat disc-shaped element including a conductive pattern disposed on a surface of the disc-shaped element, wherein the physical shape of the conductive pattern is at least partially defined by a fractal geometry and that is configured and arranged to receive and transmit electromagnetic radiation; and a conical portion connected to the flat-shaped disc element.

2. The apparatus of claim 1 wherein the physical shape of the disc-shaped element is at least partially defined by a hole.

* * * * *